United States Patent [19]

Dickson

[11] 4,177,063

[45] Dec. 4, 1979

[54] METHOD AND APPARATUS FOR REDUCING METAL OXIDE

[75] Inventor: Eric W. Dickson, Taunton, England

[73] Assignee: The Glacier Metal Company Limited, Middlesex, England

[21] Appl. No.: 887,515

[22] Filed: Mar. 17, 1978

[30] Foreign Application Priority Data

Mar. 16, 1977 [GB] United Kingdom ..... 11020/77

[51] Int. Cl.[2] ..... C21C 7/00

[52] U.S. Cl. ..... 75/62; 75/40; 75/63; 75/65 R; 75/93 R

[58] Field of Search ..... 75/63, 65, 10, 11, 40, 75/61, 62, 93

[56] References Cited

U.S. PATENT DOCUMENTS

| | | | |
|---|---|---|---|
| 3,326,671 | 6/1967 | Worner | 75/40 |
| 3,572,671 | 3/1971 | Worner | 75/93 |
| 3,827,877 | 8/1974 | Pantke | 75/11 |

*Primary Examiner*—P. D. Rosenberg

*Attorney, Agent, or Firm*—Oblon, Fisher, Spivak, McClelland & Maier

[57] ABSTRACT

Method of reducing metal oxide on the surface of a bath of molten metal, wherein the geometry and the heat source in the bath are arranged so as to create a temperature difference on the surface of the bath comprising a first hotter region A and a second cooler region B, with a temperature difference between regions A and B of about 500°-700° C. which comprises supplying metal oxide to the hotter region A, circulating the molten metal bath by means of convection currents so that the surface of the bath moves continuously from region A to region B, thereby carrying the metal oxide continuously on the surface of the bath from region A to region B, contacting the surface of the bath with a reducing atmosphere, thereby reducing the continuously moving metal oxide to metal, and removing metal at the region B by means of a lip present in the bath.

9 Claims, 1 Drawing Figure

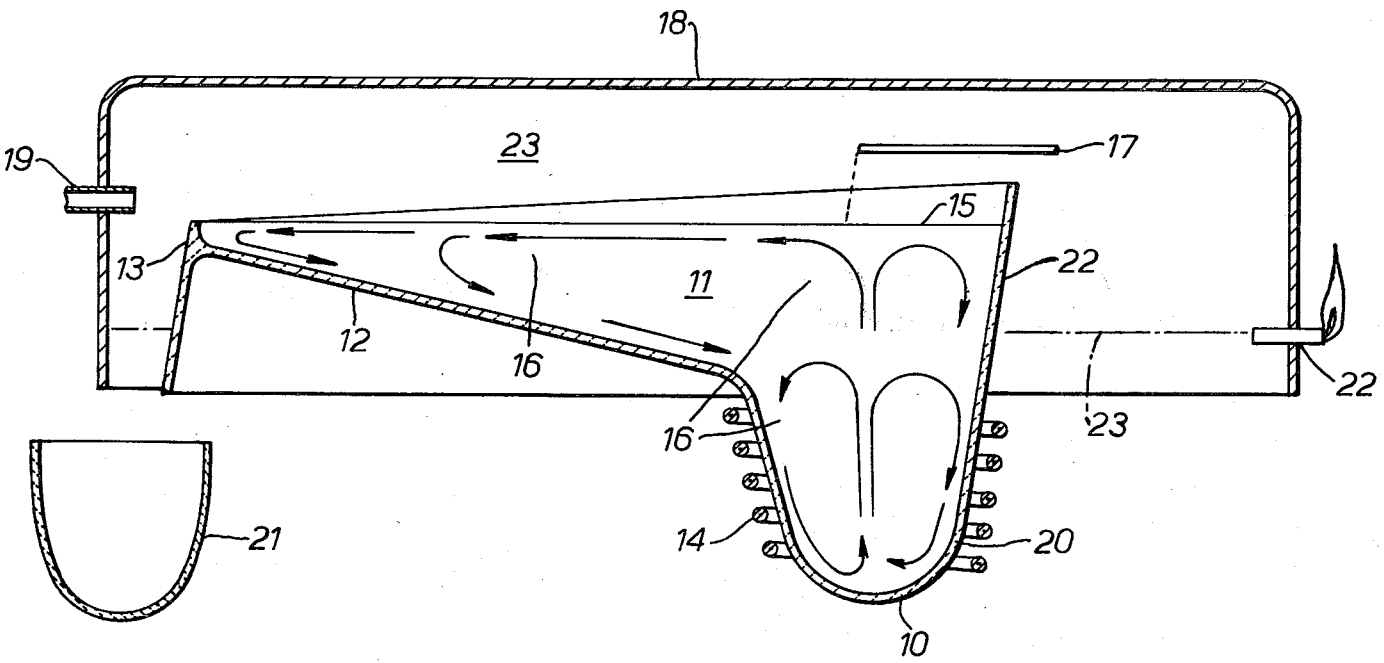
22
23
17
22
20
15
10
18
11
16
14
23
16
12
21
13
19

METHOD AND APPARATUS FOR REDUCING METAL OXIDE

FIELD OF THE INVENTION

This invention relates to a method and apparatus for reducing metal oxide to the metal, and one object is to provide such a method and process enabling the metal in a metal oxide dust to be continuously recovered.

SUMMARY OF THE INVENTION

According to the invention, in a method of reducing metal oxide, the oxide is supplied to molten metal in a crucible and is carried by circulation of the molten metal in the crucible in a reducing atmosphere to a lip over which the recovered metal flows for collection.

DESCRIPTION OF THE PREFERRED EMBODIMENTS

The metal oxide is conveniently in the form of dust or powder applied in a thin layer to the surface of the molten metal in the crucible.

By appropriate design of the shape of the crucible and by the use of controlled induction heating, a combination of electromagnetic eddy currents and convection currents can cause continuous circulation of the molten metal in the crucible, such that the dust is carried at the surface of the molten metal from the hottest part to a cooler part, and flows all the time in contact with the reducing atmosphere so that it will be reduced to the metal by the time it reaches the coolest part at the lip, and after flowing over the lip it can be collected.

The invention includes apparatus for reducing metal oxide, which apparatus comprises a crucible with a main well and a sideways extension from the side wall near the top of the main well, an induction heater arranged to heat metal in the main well, and a lip at the outer end of the extension over which molten metal can flow.

The invention is particularly suitable for recovering white metal from white metal oxide dust obtained from scrappings, spillings, and used white metal in the manufacture and repair of white metal lined plain bearings, and enables waste material, which would otherwise give rise to a problem of disposal to be reclaimed for subsequent use in bearing linings.

The invention may be carried into practice in various ways, and one embodiment will be described by way of example, with reference to the accompanying drawing, of which the single FIGURE is a diagrammatic sectional elevation of equipment for reducing metal oxide dust.

A crucible 10 is filled to over-flowing with molten metal 11, which is the same as the metal constituent of the metal oxide dust which is to be reduced, and which is continuously applied to the surface of the molten metal at 15 from a conveyor 17 in a single layer covering of the molten metal. In the example being described, the metal is a white metal alloy, and the metal oxide dust is waste material produced during the manufacture and repair of white metal bearing linings.

The crucible has a main body portion in the form of a frusto-conical well 20 with a curved bottom, but there is a narrow extension to one side of the side wall of the well as indicated at 12, leading to a lip or weir 13 lower than the rest of the side wall 22 of the crucible, and over which molten metal can flow into a crucible 21.

The lower part of the well is surrounded by an induction heating coil 14, which is energised sufficiently for the temperature of the surface of the white metal at 15 above the well to be within the range 900° C. to 1100° C. The shape and disposition of the extension 12 is such that the temperature at the lip 13 is about 400° C.

The coil 14 induces eddy currents in the molten metal in the well, and the effect of those eddy currents together with the natural convection currents, due to the temperature distribution throughout the molten metal causes the molten metal to move in directions indicated by the arrows 16.

It will be seen that there is flow of molten metal from the centre of the surface 15 above the well out to the lip 13, and then back down the inclined bottom of the extension 12 into the main part of the well, and that causes the metal oxide dust arriving at 15 to be carried out to the lip 13.

The surface of the crucible 10 is covered by a housing 18 into which a reducing gas is introduced at an inlet 19 so as to flow generally contrary to the flow of metal in the crucible 10 which will thus be exposed to the reducing action of the gas. A gas escape and monitor pipe 22 at the lowest level of the gas in the area 23 within the housing 18 allows for gas to escape, and can give an indication of the lowest level of the reducing gas at 23.

The continuous supply of material to the crucible at 15 causes molten metal which has been reduced to overflow at 13 into the crucible 21, and by keeping the temperature at the lip 13 at about 400° C., oxidation as the overflowing metal leaves the reducing atmosphere 23 is reduced to a minimum.

If there is any oxide that is not reduced and is carried out over the lip 13, it will reappear as dross on the metal in the crucible 21 from where it can readily be removed.

By appropriate choice of the temperatures, and reducing gases, it is possible to reduce particular metal oxides or groups of metal oxides in a continuous process with the oxide dust arriving at 17, and the recovered metal collected at 21. In a particular example the reducing gas may be hydrogen or hydrogen/nitrogen.

What is claimed as new and intended to be covered by Letters Patent of the United States is:

1. A method of reducing metal oxide on the surface of a bath of molten metal, wherein the geometry and the heat source in said bath are arranged so as to create a temperature difference on the surface of said bath comprising a first hotter region A and a second cooler region B, with a temperature difference between said regions of about 500°–700° C., which comprises supplying metal oxide to said hotter region A, circulating the molten metal bath by means of convection currents so that the surface of said bath moves continuously from said region A to said region B, thereby carrying said metal oxide continuously on the surface of said bath from said region A to said region B, contacting the surface of said bath with a reducing atmosphere, thereby reducing said continuously moving metal oxide to metal, and removing metal at said region B by means of a lip present in said bath.

2. A method as claimed in claim 1 in which the molten metal is the same metal as the metal whose oxide is being reduced.

3. A method as claimed in claim 1 in which the metal oxide is applied as a powder to the surface of the molten metal.

4. A method as claimed in claim 1 in which the metal circulates in the crucible by reason of convection and electro-magnetic currents.

5. A method as claimed in claim 1 in which the reducing atmosphere is provided by a gas caused to flow over the molten metal surface in a direction opposite to the direction of circulation.

6. A method as claimed in claim 1 operated as a continuous process with metal oxide being provided to the crucible and recovered metal being collected at the lip.

7. The method of claim 1 wherein said metal oxide is obtained from waste metal material.

8. The method of claim 1 wherein said hotter region A has a temperature of 900°-1100° C.

9. The method of claim 1 wherein said cooler region B is at a temperature of about 400° C.

* * * * *